US010308411B2

(12) United States Patent
Spann et al.

(10) Patent No.: US 10,308,411 B2
(45) Date of Patent: Jun. 4, 2019

(54) SHELL AND RETAINER CONTAINMENT SYSTEM FOR DUAL BOTTLES

(71) Applicant: SNYDER INDUSTRIES, INC., Lincoln, NE (US)

(72) Inventors: Herbert H. Spann, Lincoln, NE (US); Darrell A. Oltman, Lincoln, NE (US)

(73) Assignee: Snyder Industries, LLC, Lincoln, NE (US)

( * ) Notice: Subject to any disclaimer, the term of this patent is extended or adjusted under 35 U.S.C. 154(b) by 0 days.

(21) Appl. No.: 15/829,447

(22) Filed: Dec. 1, 2017

(65) Prior Publication Data

US 2018/0155101 A1 Jun. 7, 2018

Related U.S. Application Data

(60) Provisional application No. 62/430,042, filed on Dec. 5, 2016.

(51) Int. Cl.

| | |
|---|---|
| ***B65D 71/00*** | (2006.01) |
| ***B65D 25/56*** | (2006.01) |
| ***B65D 21/02*** | (2006.01) |
| ***B65D 25/30*** | (2006.01) |
| ***B65D 77/04*** | (2006.01) |

(52) U.S. Cl.

CPC ..... *B65D 71/0088* (2013.01); *B65D 21/0212* (2013.01); *B65D 25/30* (2013.01); *B65D 25/56* (2013.01); *B65D 77/0453* (2013.01)

(58) Field of Classification Search

CPC .... B65D 21/02; B65D 21/0212; B65D 25/30; B65D 25/56; B65D 71/00; B65D 71/0088; B65D 77/04; B65D 77/0453; B65D 85/30

USPC ..... 206/430, 431, 585, 588–590; 220/23.83, 220/23.87, 23.88, 23.89, 592.15, 592.2, 220/592.23

See application file for complete search history.

(56) References Cited

U.S. PATENT DOCUMENTS

| | | | | | |
|---|---|---|---|---|---|
| 4,782,945 | A * | 11/1988 | Geiler | B65D 1/0276 | 206/431 |
| 4,927,042 | A * | 5/1990 | Ring | B65D 21/0237 | 206/431 |
| 7,988,005 | B2 * | 8/2011 | Wagner | B44D 3/122 | 220/23.83 |
| 8,381,932 | B2 * | 2/2013 | Wagner | B65D 21/0209 | 206/430 |
| 8,403,163 | B2 * | 3/2013 | Spann | B65D 21/0237 | 206/585 |

(Continued)

*Primary Examiner* — Bryon P Gehman

(74) *Attorney, Agent, or Firm* — Hovey Williams LLP

(57) ABSTRACT

A shell and retainer containment system for storing and transporting bottles, comprising an outer shell and an upper retainer. The outer shell includes a base, a number of sidewalls, and a top rim cooperatively forming a central cavity. The top rim includes a set of handles, a set of forklift fork openings for lifting the outer shell and retainer containment system via a forklift fork, and stacking geometry. The upper retainer secures the bottles in the central cavity and includes a brace and four corner reinforcements. The brace is positioned above the bottles and includes access openings for allowing access to bung openings of the bottles. The corner reinforcements extend upwards toward upper corners of the outer shell and include fastener openings for attaching the upper retainer to the outer shell via fasteners for securing the bottles in the central cavity.

20 Claims, 6 Drawing Sheets

(56) References Cited

U.S. PATENT DOCUMENTS

| | | | | |
|---|---|---|---|---|
| 8,679,425 | B2 * | 3/2014 | Ueda | B01L 3/0293 220/23.2 |
| 9,033,173 | B2 * | 5/2015 | Beyer | B65D 19/04 220/23.91 |
| 2012/0312813 | A1 * | 12/2012 | Voelker | B65D 5/4204 220/23.89 |

* cited by examiner

SHELL AND RETAINER CONTAINMENT SYSTEM FOR DUAL BOTTLES

RELATED APPLICATIONS

This regular utility non-provisional patent application claims priority benefit with regard to all common subject matter of earlier-filed provisional U.S. patent application Ser. No. 62/430,042 filed on Dec. 5, 2016, and entitled "SHELL AND RETAINER CONTAINMENT SYSTEM FOR DUAL BOTTLES". The identified earlier-filed provisional patent application is hereby incorporated by reference in its entirety into the present application.

BACKGROUND

Liquid storage bottles are often used for storing, transporting, and dispensing chemicals, petroleum products, and other liquids. However, some bottles have rounded or angled bottoms, which prevents them from being set firmly on a ground surface. Many bottles do not have handles or lifting features, which prevents them from being easily lifted and handled. Many bottles also do not have volume markings, which makes it difficult to determine how much liquid is currently in them. It is often desirable to keep and transport multiple bottles together, but known bottles do not have any pairing or connecting features.

Conventional containers, such as boxes and crates, can be used to hold and transport multiple bottles, but such containers do not adequately support the bottles, causing damage to the bottles and spills. Conventional containers are also typically designed to either secure bottles or provide easy access to the bottles, but not both.

SUMMARY

The present invention solves the above-described and other problems and limitations by providing a shell and retainer containment system that securely supports and restrains two or more bottles without blocking access to their filling and dispensing openings.

An embodiment of the shell and retainer containment system broadly comprises an outer shell and an upper retainer, both of which may be molded of synthetic resin materials or other suitable materials.

The outer shell includes a base, a number of sidewalls, and a top rim cooperatively forming a central cavity. The base includes a lowermost support, an elevated sloped section, and a sump section. The lowermost support is configured to rest on a ground surface, a shelf, or a top of another shell and may include stacking geometry for interlocking with or engaging stacking geometry of the top of the other shell. The stacking geometry may include recesses, bosses, protrusions, grooves, ridges, guides, or any other suitable geometry.

The elevated sloped section is angled downward from above the lowermost support to the sump section and is shaped to at least partially support sloped portions of the bottles. The sump section receives sump portions of the bottles and is level with or slightly elevated above the lowermost support.

The sidewalls vertically extend from the base to the top rim and include a set of windows configured to allow a user to view a level or amount of liquid contained in the bottles. The windows may be positioned in vertical columns so that each window corresponds to a different level or amount of fluid. For example, a bottom window may be positioned such that a bottle has approximately twenty liters if the fluid level is visible through the bottom window. The top window may be positioned such that the bottle has approximately one hundred liters if the fluid level is visible through the top window. Additional windows may be positioned between the bottom and top windows at twenty liter increments or any other suitable increment.

The top rim is the uppermost portion of the outer shell and includes a set of handles, a set of forklift fork openings, and stacking geometry. The handles allow the user to pick up the shell and retainer containment system by hand. The forklift fork openings are aligned with each other for receiving a forklift fork therethrough for lifting the shell and retainer containment system via a forklift. In one embodiment, the top rim includes four handles spaced orthogonally from each other and four forklift fork openings spaced orthogonally from each other for lifting the shell and retainer containment system from any direction.

The stacking geometry of the top rim interlocks with or engages stacking geometry of the base of another shell. The stacking geometry may include recesses, bosses, protrusions, grooves, ridges, guides, or any other suitable geometry.

The upper retainer retains the bottles in the central cavity and includes a brace and four corner reinforcements. The brace includes access openings for allowing access to bung openings of the bottles and is configured to be positioned above the bottles when the upper retainer is inserted into the central cavity over the bottles. In one embodiment, a first access opening provides access to the bung openings of a first bottle while a second access opening provides access to the bung openings of a second bottle.

The corner reinforcements extend upwards toward upper corners of the shell and may include fastener openings or other features for securing the upper retainer to the shell via a number of fasteners. That is, the fasteners keep the upper retainer in place and hence secure the bottles in the central cavity of the shell.

The above-described shell and retainer containment system provides several advantages over conventional bottle containment systems. For example, the upper retainer secures the bottles in the outer shell while providing access to the bung openings of the bottles via the access openings. The upper retainer also does not obscure the handles and forklift fork openings such that the shell and retainer containment system can be lifted and transported by hand or via a forklift fork extending through one or two of the forklift fork openings.

The outer shell ensures that the bottles are properly positioned and restrained in the central cavity. The base of the outer shell does not have any holes or openings such that any fluid spilled or leaked from the bottles is retained in the central cavity. The outer shell may be mirrored or shaped so that the bottles can only fit into the central cavity a predetermined way, which ensures that the bottles are not switched or loaded improperly. This may be desirable if the bottles hold different fluids or chemicals that must be not be mistaken for each other.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

BRIEF DESCRIPTION OF THE DRAWING FIGURES

Embodiments of the present invention are described in detail below with reference to the attached drawing figures, wherein.

Figure 1:
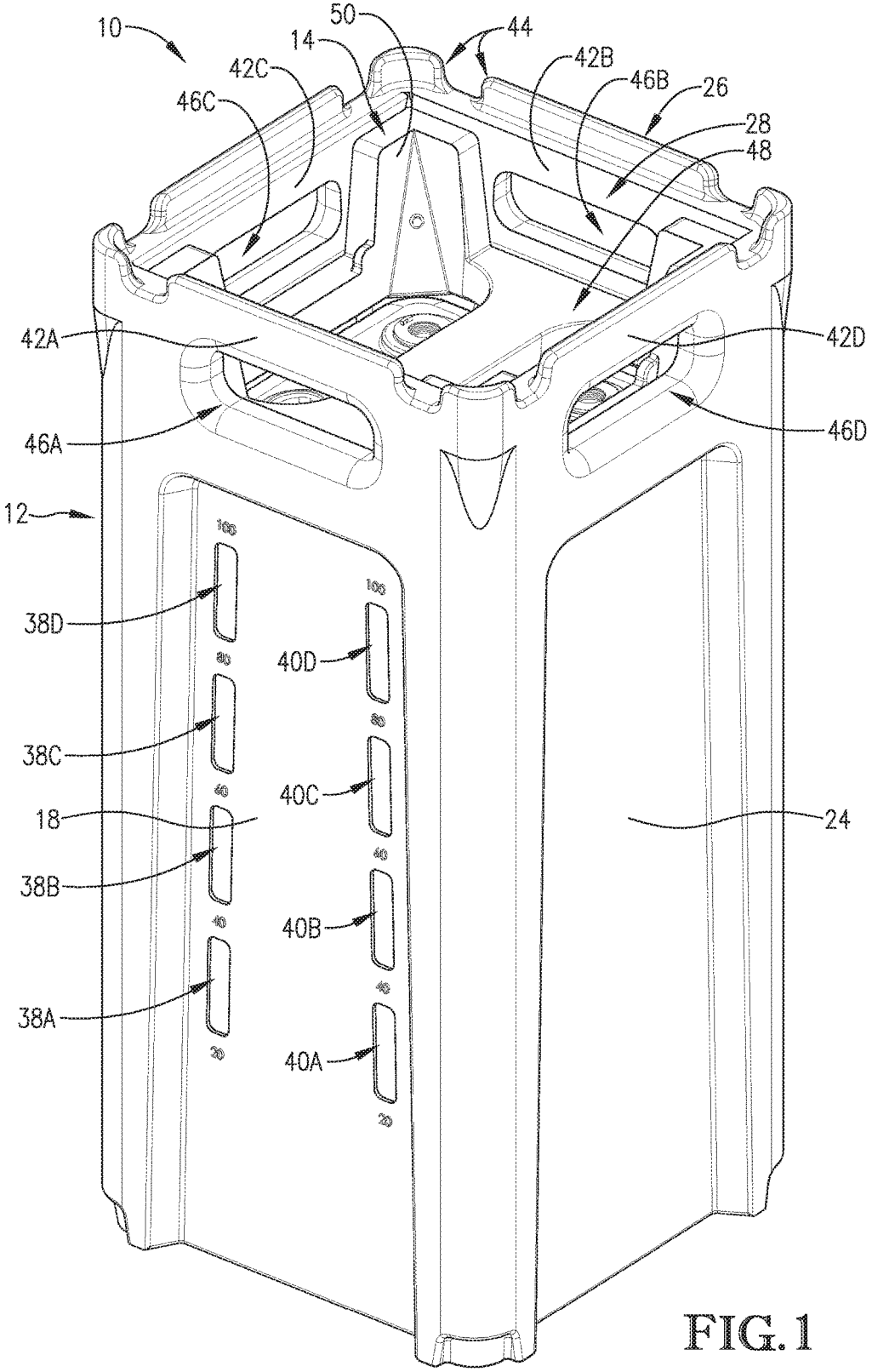
FIG. 1 is a perspective view of a shell and retainer containment system constructed in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the claims of a subsequent patent, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a shell and retainer containment system 10 constructed in accordance with an embodiment of the invention is illustrated. The shell and retainer containment system 10 firmly supports and provides access to two or more bottles. The shell and retainer containment system 10 can be used with bottles of any type, size, and shape.

Figure 2:
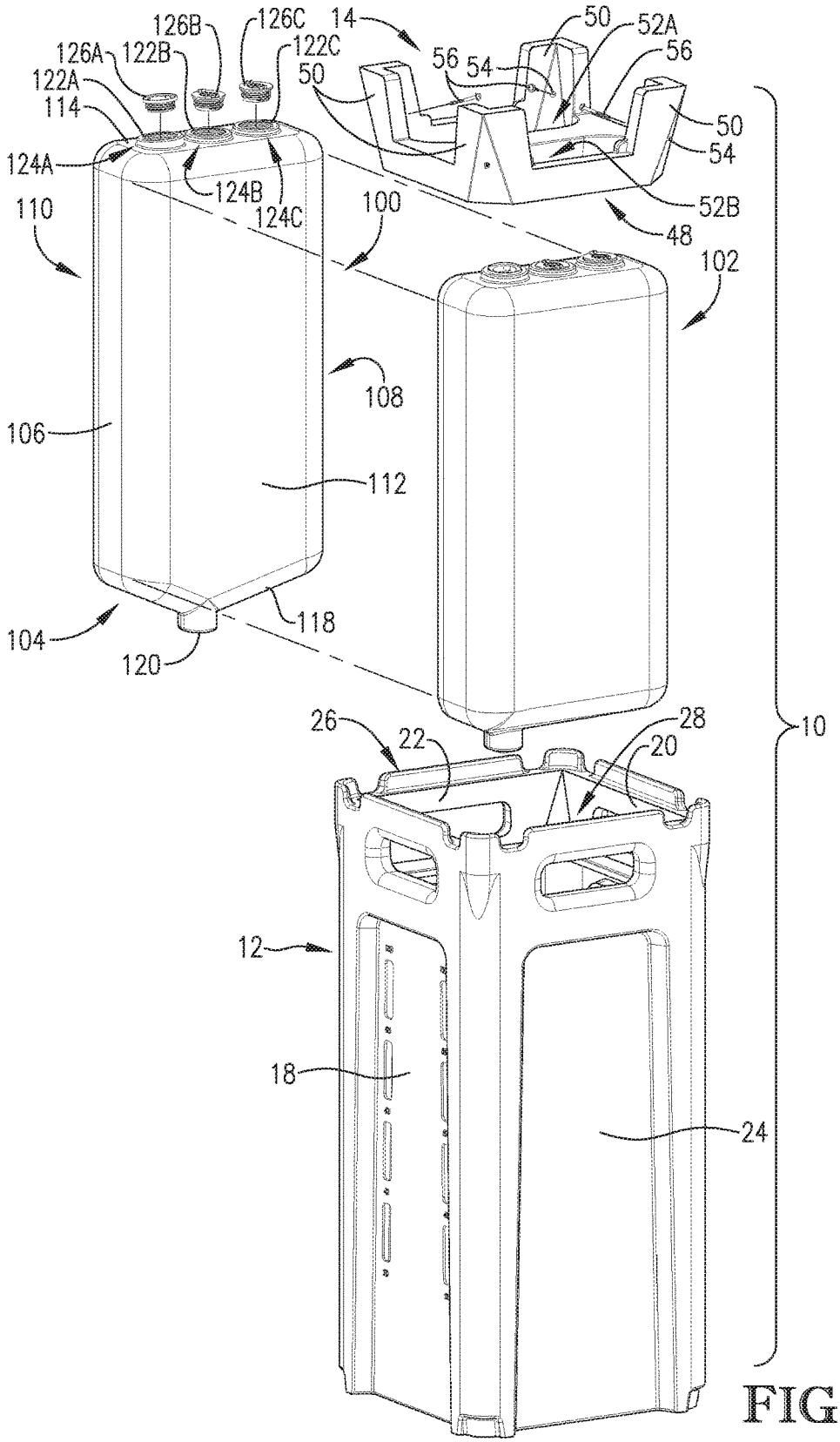
FIG. 2 is an exploded view of the shell and retainer containment system of FIG. 1.
Figure 3:
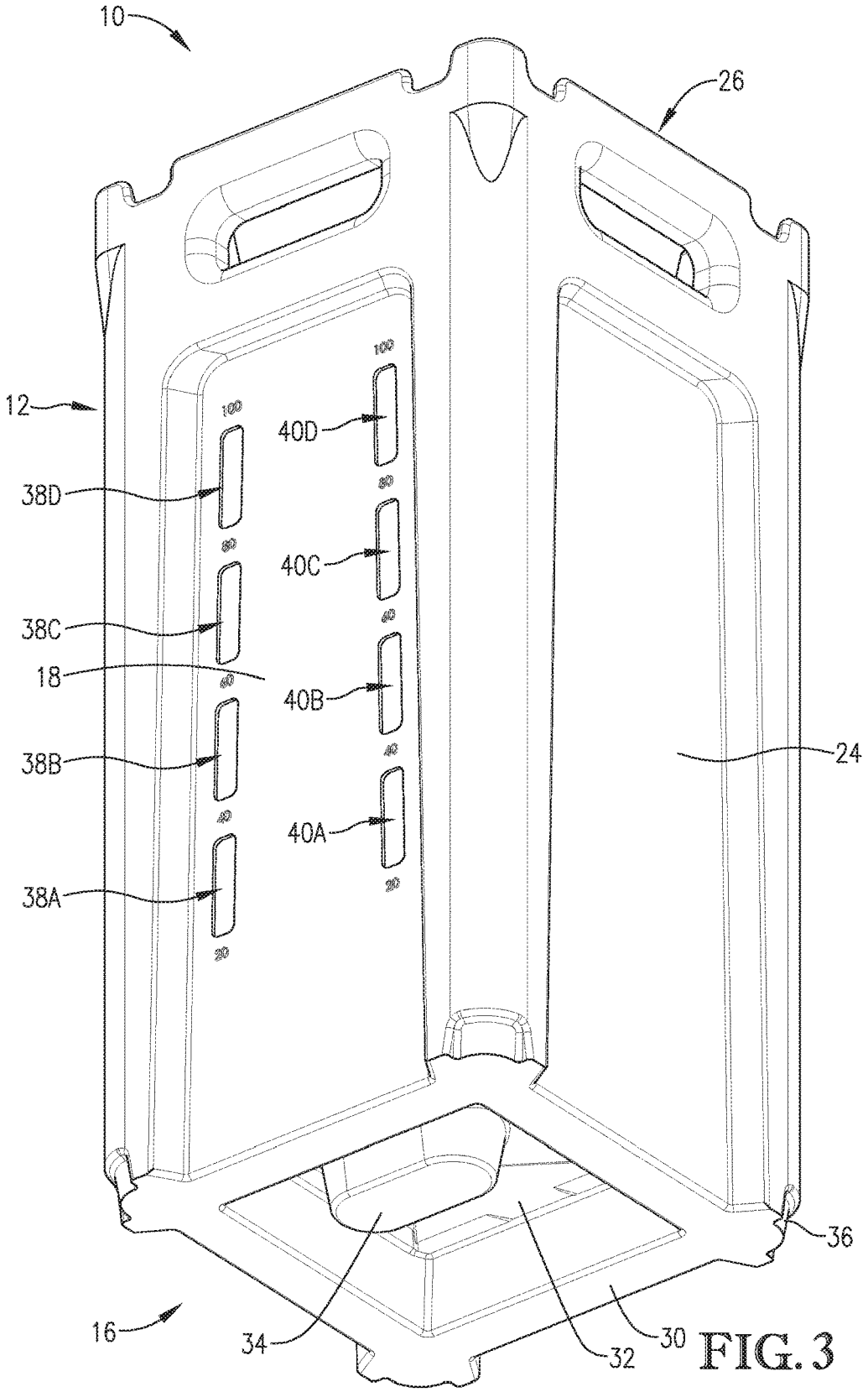
FIG. 3 is a bottom perspective view of the shell and retainer containment system of FIG. 1.
Figure 4:
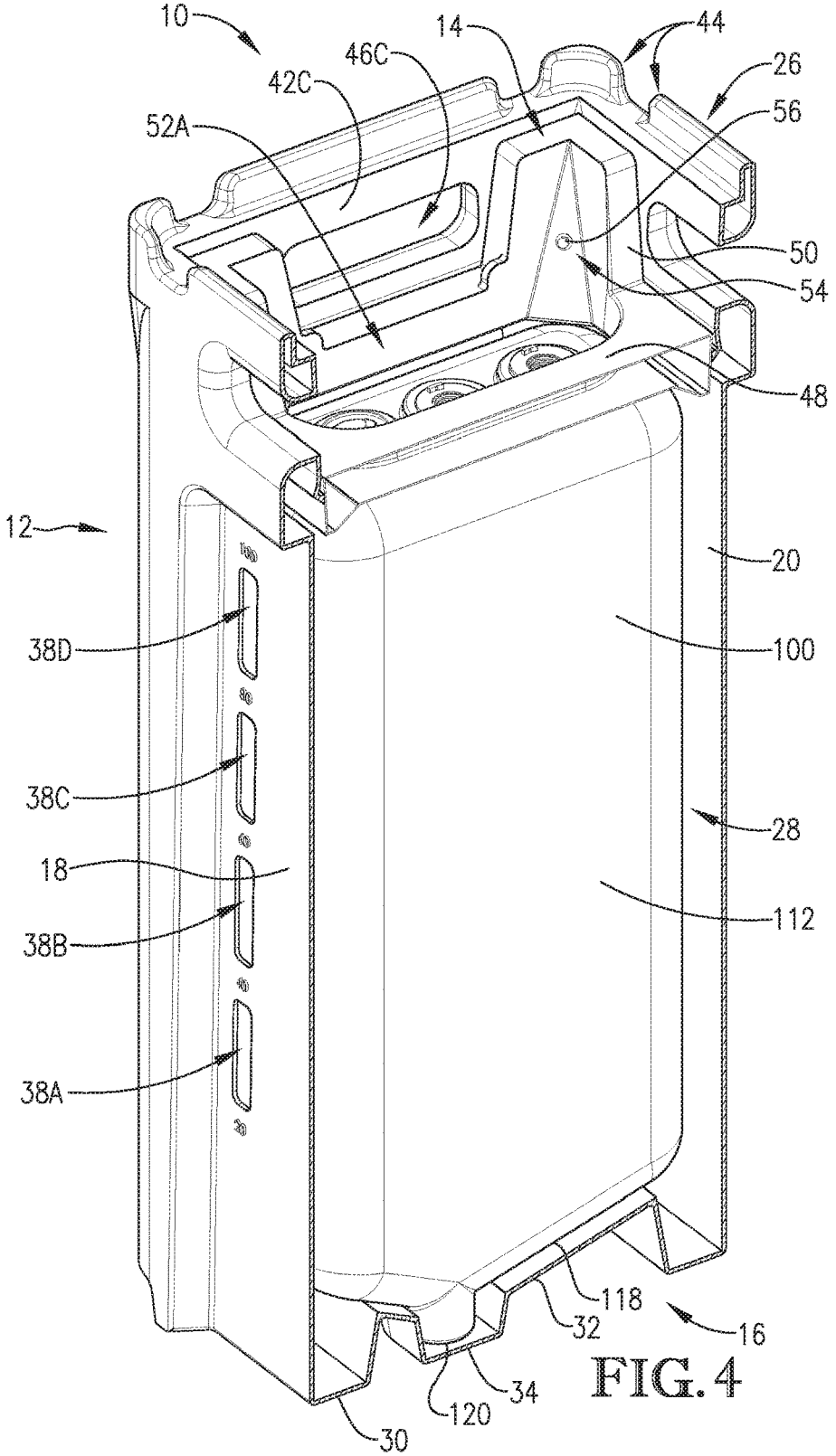
FIG. 4 is a cutaway perspective view of the shell and retainer containment system of FIG. 1.
Figure 5:
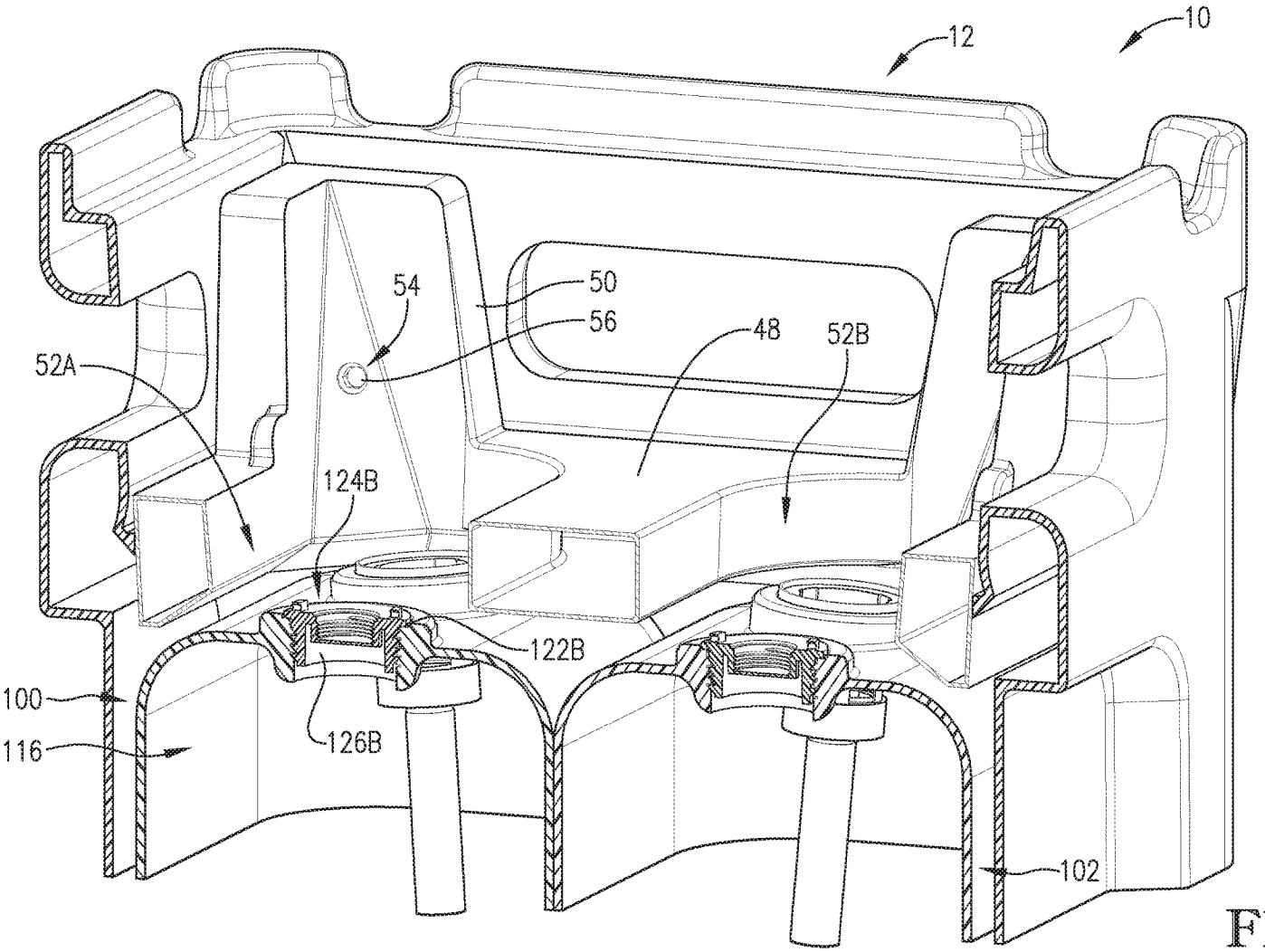
FIG. 5 is a partial cutaway perspective view of the shell and retainer containment system of FIG. 1.
Figure 6:
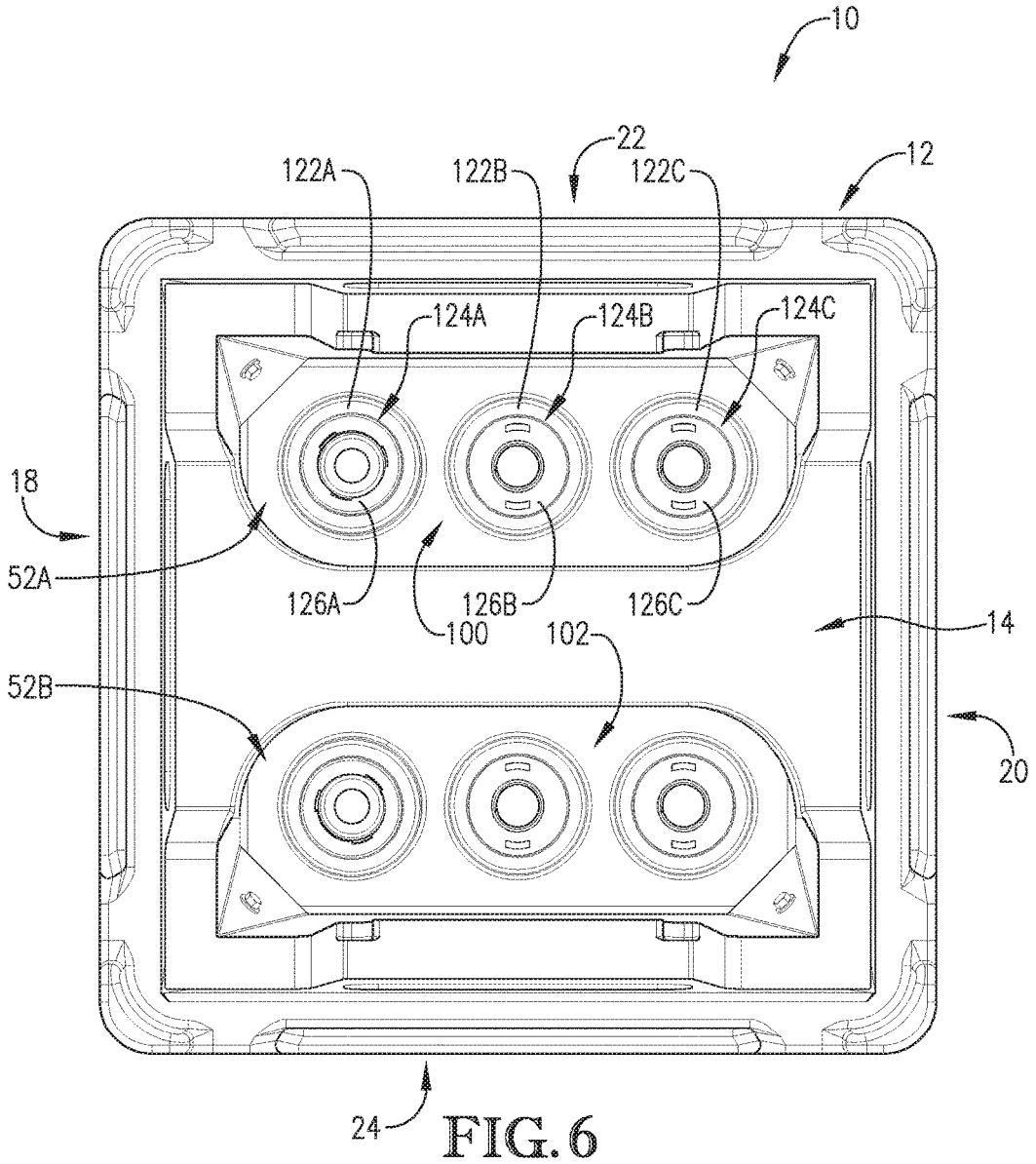
FIG. 6 is a top plan view of the shell and retainer containment system of FIG. 1.

Exemplary bottles 100, 102 are shown in FIGS. 2-6 and each include a bottom wall 104, a plurality of sidewalls including a front sidewall 106, a rear sidewall 108, a left sidewall 110, and a right sidewall 112, and a top wall 114 cooperatively forming an interior chamber 116. The bottles 100, 102 are substantially similar and thus only bottle 100 will be described in detail.

The bottom wall 104 includes a sloped portion 118 and a sump portion 120. The sloped portion 118 is angled downward to the sump portion 120. The sump portion 120 is the lowest-most point of the bottle 100 and may be positioned near a corner of the bottom wall 104.

The front sidewall 106 extends vertically between front edges of the bottom wall 104 and top wall 114 and may be substantially flat or curved. The front sidewall 106 may have ridges or other features for increased strength and rigidity.

The rear sidewall 108 extends vertically between rear edges of the bottom wall 104 and top wall 114 and is substantially similar to the front sidewall 106. That is, the rear sidewall 108 may be substantially flat or curved and may have ridges or other features for increased strength and rigidity.

The left sidewall 110 extends vertically between left edges of the bottom wall 104 and top wall 114 and may be substantially flat or curved. The left sidewall 110 may be at least twice as wide as the front and rear sidewalls 106, 108 and may have ridges or other features for increased strength and rigidity.

The right sidewall 112 extends vertically between right edges of the bottom wall 104 and top wall 114 and may be substantially similar to the left sidewall 110. That is, the right sidewall 112 may be substantially flat or curved and may have ridges or other features for increased strength and rigidity.

The top wall 114 includes a plurality of bung rims 122A-C forming bung openings 124A-C configured to receive bung caps 126A-C therein. One of the bung openings 124A-C may be angled for allowing for a dip tube to be aligned with the sump portion 120 while the other two bung openings 124A-C may be relatively flat. In one embodiment, the bung openings 124A-C are spaced from each other in a straight line.

The bottles 100, 102 may be interchangeable with each other or non-interchangeable. For example, the bottles 100, 102 may be mirror images of each other or may have unique geometry or different colors representing the liquids that should be stored in them. The bottles 100, 102 may be formed of metal, molded plastic, glass, or any other suitable material.

An embodiment of the shell and retainer containment system 10 will now be described in detail. The shell and retainer containment system 10 broadly comprises an outer shell 12 and an upper retainer 14.

The outer shell 12 protects the bottles 100, 102 and broadly comprises a base 16, a plurality of sidewalls including a front sidewall 18, a rear sidewall 20, a left sidewall 22, and a right sidewall 24, and a top rim 26 cooperatively forming a central cavity 28. The base 16 includes a lowermost support 30, an elevated sloped section 32, and a sump section 34. The lowermost support 30 is configured to rest on a ground surface, a shelf, or a top of another shell and may include stacking geometry 36 for interlocking with or engaging stacking geometry of the top of another shell. The stacking geometry 36 may include recesses, bosses, protrusions, grooves, ridges, guides, or any other suitable geometry.

The elevated sloped section 32 is raised relative to the lowermost support 30 and angles downwardly to the sump section 34 for at least partially supporting the sloped portions 118 of the bottles 100, 102. The sump section 34 is below the sloped section but above the lowermost support 30 to receive the sump portions 126 of the bottles 100, 102.

The front sidewall 18 extends vertically between front edges of the base 16 and the top rim 26 and may include a first set of windows 38A-D and a second set of windows 40A-D configured to allow a user to view a level or amount of liquid contained in the bottles 100, 102. The first set of windows 38A-D may be positioned in a vertical column on a left side of the front sidewall 18 so that each window of the first set corresponds to a different level or amount of fluid in the left bottle 100. For example, a bottom window 38A may be positioned such that the left bottle 100 has approximately twenty liters if the fluid level is visible through the bottom window 38A. The top window 38D may be positioned such that the left bottle 100 has approximately one hundred liters if the fluid level is visible through the top window 38D. Additional windows 38B,C may be positioned between the bottom and top windows 38A,D at twenty liter increments or any other suitable increment.

The second set of windows 40A-D may be positioned in a vertical column on a right side of the front sidewall 18 so that each window of the second set corresponds to a different level or amount of fluid in the right bottle 102. For example, a bottom window 40A may be positioned such that the right bottle 102 has approximately twenty liters if the fluid level is visible through the bottom window 40A. The top window 40D may be positioned such that the right bottle 102 has approximately one hundred liters if the fluid level is visible through the top window 40D. Additional windows 40B,C may be positioned between the bottom and top windows 40A,D at twenty liter increments or any other suitable increment.

The front sidewall 18 may also be contoured for increasing rigidity and strength of the outer shell 12. For example, the front sidewall 18 may form vertical legs at corners of adjacent sidewalls for supporting the weight of other shell and retainer containment systems stacked on top of the outer shell 12.

The rear sidewall 20 extends vertically between rear edges of the base 16 and the top rim 26 and may be substantially similar to the front sidewall 18. That is, the rear sidewall 20 may be contoured for increasing rigidity and strength of the outer shell 12. For example, the rear sidewall 20 may form vertical legs at corners of adjacent sidewalls for supporting the weight of other shell and retainer containment systems stacked on top of the outer shell 12.

The left sidewall 22 extends vertically between left edges of the base 16 and the top rim 26 and may be substantially similar to the front and rear sidewalls 18, 20. That is, the left sidewall 22 may be contoured for increasing rigidity and strength of the outer shell 12. For example, the left sidewall 22 may form vertical legs at corners of adjacent sidewalls for supporting the weight of other shell and retainer containment systems stacked on top of the outer shell 12.

The right sidewall 24 extends vertically between right edges of the base 16 and the top rim 26 and may be substantially similar to the front, rear, and left sidewalls 18, 20, 22. That is, the right sidewall 24 may be contoured for increasing rigidity and strength of the outer shell 12. For example, the right sidewall 24 may form vertical legs at corners of adjacent sidewalls for supporting the weight of other shell and retainer containment systems stacked on top of the outer shell 12.

The top rim 26 is the uppermost portion of the outer shell 12 and includes a set of handles 42A-D, a set of forklift fork openings 44A-D, and stacking geometry 46. The handles 42A-D allow the user to pick up the shell and retainer containment system 10 by hand and may be orthogonally spaced from each other. The forklift fork openings 44A-D are configured to receive a forklift fork therethrough and may be orthogonally spaced from each other positioned directly below the handles 42A-D. This allows the user to pick up and transport the shell and retainer containment system 10 from any direction.

The stacking geometry 46 interlocks with or engages stacking geometry of the base of another shell. The stacking geometry 46 may include recesses, bosses, protrusions, grooves, ridges, guides, or any other suitable geometry.

The upper retainer 14 secures the bottles 100, 102 in the central cavity 28 and includes a brace 48 and a set of corner reinforcements 50. The brace 48 is configured to be positioned above the bottles 100, 102 when the upper retainer 14 is inserted into the central cavity 42 over the bottles 100, 102 and includes first and second access openings 52A, B for allowing access to the bung openings 124A-C of the bottles 100, 102. In one embodiment, the first access opening 52A provides access to the bung openings of bottle 100 while the second access opening 52B provides access to the bung openings of bottle 102.

The corner reinforcements 50 extend upwards toward upper corners of the shell 12 and may include fastener openings 54 or other features for attaching the upper retainer 14 to the shell 12 via fasteners 56. That is, the fasteners 56 keep the upper retainer 14 in place and hence secure the bottles 100, 102 in the central cavity 42 of the shell 12.

The above-described shell and retainer containment system 10 provides several advantages over conventional containment systems. For example, the upper retainer 14 secures the bottles 100, 102 in the outer shell 12 while providing access to the bung openings 124A-C of the bottles 100, 102 via the access openings 52. The upper retainer 14 also does not obscure the handles 42 and forklift fork openings 44 such that the shell and retainer containment system 10 can be lifted and transported by hand or via a forklift fork extending through one or two of the forklift fork openings 44.

The outer shell 12 ensures that the bottles 100, 102 are properly positioned and restrained in the central cavity 28. The base 16 of the outer shell 12 may not have any holes or openings such that any fluid spilled or leaked from the bottles 100, 102 is retained in the central cavity 28. The outer shell 12 may be mirrored or shaped so that the bottles 100, 102 can only fit into the central cavity 28 a predetermined way, which ensures that the bottles 100, 102 are not switched or loaded improperly. This may be desirable if the bottles 100, 102 hold different fluids or chemicals that must not be mistaken for each other.

Although the invention has been described with reference to the embodiments illustrated in the attached drawing figures, it is noted that equivalents may be employed and substitutions made herein without departing from the scope of the invention.

Having thus described various embodiments of the invention, what is claimed as new and desired to be protected by Letters Patent includes the following:

1. A shell and retainer containment system for storing and transporting bottles, the shell and retainer containment system comprising:

an outer shell forming an open-topped central cavity for holding the bottles therein, the outer shell comprising:
- a base for supporting the bottles on a ground surface;
- a plurality of sidewalls extending upwards from the base; and
- a top rim extending above the sidewalls, the top rim having a plurality of handles for allowing a user to lift the shell and retainer containment system by hand; and an upper retainer comprising:

a brace having an access opening for providing access to bung openings of the bottles, the brace being configured to be positioned above the bottles when the bottles are positioned in the open-topped central cavity of the outer shell; and a plurality of corner reinforcements extending upwards from the brace and being configured to be connected to the outer shell for securing the bottles in the open-topped central cavity.

2. The shell and retainer containment system of claim 1, wherein the base further comprises a lowermost support having stacking geometry for engaging stacking geometry of a top of another shell and retainer containment system.

3. The shell and retainer containment system of claim 1, wherein the bottles each include a bottom wall having an angled portion, the base further comprising an elevated sloped section for at least partially supporting the angled bottom portion.

4. The shell and retainer containment system of claim 1, wherein the bottles have sump portions, the base further comprising a sump section configured to receive the sump portions of the bottles.

5. The shell and retainer containment system of claim 1, wherein the sidewalls include a plurality of windows for allowing the user to view a fluid level of the bottles, the windows corresponding to predetermined fluid levels.

6. The shell and retainer containment system of claim 1, wherein the top rim further comprises forklift openings configured to receive a forklift fork therethrough for allowing the user to lift the shell and retainer containment system via a forklift.

7. The shell and retainer containment system of claim 6, wherein the top rim comprises four handles spaced orthogonally from each other and four forklift openings spaced orthogonally from each other for allowing the shell and retainer containment system to be lifted from four directions.

8. The shell and retainer containment system of claim 1, wherein the top rim further comprises stacking geometry for engaging stacking geometry of a base of another shell and retainer containment system.

9. The shell and retainer containment system of claim 1, wherein the outer shell is configured to hold first and second bottles each having a plurality of bung openings, the access opening of the upper retainer including a first access opening for providing access to the bung openings of the first bottle and a second access opening for providing access to the bung openings of the second bottle.

10. The shell and retainer containment system of claim 1, wherein the corner reinforcements include fastener holes configured to receive fasteners therethrough for attaching the upper retainer to the outer shell.

11. A shell and retainer containment system for storing and transporting bottles each having a bottom wall, a sidewall, and a top wall including a plurality of bung openings, the shell and retainer containment system comprising:

a molded plastic outer shell forming an open-topped central cavity for holding the bottles therein, the outer shell comprising:

a base for supporting the bottles on a ground surface;

a plurality of sidewalls extending upwards from the base, the sidewalls having strengthening contours; and a top rim extending above the sidewalls, the top rim having:

a plurality of handles for allowing a user to lift the shell and retainer containment system by hand; and a plurality of forklift fork openings configured to receive a forklift fork therethrough for allowing the user to lift the shell and retainer containment system via a forklift; and a molded plastic upper retainer comprising:

a brace having an access opening for providing access to the bung openings of the bottles, the brace being configured to be positioned above the bottles when the bottles are positioned in the open-topped central cavity of the outer shell; and a number of corner reinforcements extending upwards from the brace, the corner reinforcements being configured to be connected to the outer shell such that the upper retainer secures the bottles in the open-topped central cavity.

12. The shell and retainer containment system of claim 11, wherein the base further comprises a lowermost support having stacking geometry for engaging stacking geometry of a top of another shell and retainer containment system.

13. The shell and retainer containment system of claim 11, wherein the bottom walls of the bottles each have an angled portion, the base further comprising an elevated sloped section for at least partially supporting the angled portions.

14. The shell and retainer containment system of claim 11, wherein the bottom walls of the bottles each include a sump portion, the base further comprising a sump section configured to receive the sump portions.

15. The shell and retainer containment system of claim 11, wherein the sidewalls include a plurality of windows for allowing the user to view a fluid level of the bottles, the windows corresponding to predetermined fluid levels.

16. The shell and retainer containment system of claim 11, wherein the top rim includes four handles orthogonally spaced from each other for allowing the shell and retainer containment system to be lifted from four directions by hand.

17. The shell and retainer containment system of claim 16, wherein the top rim includes four forklift openings orthogonally spaced from each other for allowing the shell and retainer containment system to be lifted from four directions via a forklift.

18. The shell and retainer containment system of claim 11, the access opening of the upper retainer including a first access opening for providing access to the bung openings of the first bottle and a second access opening for providing access to the bung openings of the second bottle.

19. The shell and retainer containment system of claim 11, wherein the corner reinforcements include fastener holes configured to receive fasteners therethrough for attaching the upper retainer to the outer shell.

20. A shell and retainer containment system for storing and transporting two bottles each including a bottom wall having an angled portion and a sump portion, a sidewall, and a top wall forming a plurality of bung openings, the shell and retainer containment system comprising:

an outer shell forming an open-topped central cavity for holding the bottles therein, the outer shell comprising:

a base comprising:

a lowermost support having stacking geometry for engaging stacking geometry of a top of another shell and retainer containment system;

an elevated sloped section for at least partially supporting the angled portions of the bottles; and a sump section configured to receive the sump portions of the bottles, the elevated sloped section sloping downward from above the lowermost support to the sump section;

a plurality of sidewalls extending upwards from the base, the sidewalls being contoured for increasing strength and rigidity of the outer shell, the sidewalls having a plurality of windows for allowing a user to view a fluid level of the bottles, the windows corresponding to predetermined fluid levels; and a top rim extending above the sidewalls, the top rim having:

a plurality of handles for allowing a user to lift the shell and retainer containment system by hand;

a plurality of forklift fork openings configured to receive a forklift fork therethrough for allowing the user to lift the shell and retainer containment system via a forklift; and stacking geometry for engaging stacking geometry of a base of another shell and retainer containment system; and an upper retainer comprising:

a brace having two access openings for providing access to the bung openings of the bottles, the brace being configured to be positioned above the bottles when the bottles are inserted into the open-topped central cavity of the outer shell; and a plurality of corner reinforcements extending upwards from the brace, the corner reinforcements including a number of fastener holes configured to receive fasteners therethrough for attaching the upper retainer to the sidewalls of the outer shell so as to secure the bottles in the open-topped central cavity.

* * * * *